United States Patent [19]

Campian

[11] Patent Number: 4,625,351

[45] Date of Patent: Dec. 2, 1986

[54] WATERBED FRAME

[76] Inventor: Jon R. Campian, 3572 Port Cove Dr., Pontiac, Mich. 48054

[21] Appl. No.: 771,418

[22] Filed: Aug. 30, 1985

[51] Int. Cl.[4] ..... E04D 15/00

[52] U.S. Cl. ..... 5/450; 5/451

[58] Field of Search ..... 5/400, 421, 422, 450, 5/451; 297/452

[56] References Cited

U.S. PATENT DOCUMENTS

| | | | |
|---|---|---|---|
| 3,736,605 | 6/1973 | Klein, Jr. | 5/450 |
| 4,145,781 | 3/1979 | Autrey et al. | 5/451 X |
| 4,180,878 | 1/1980 | Howell | 5/451 X |
| 4,532,662 | 8/1985 | Sama | 5/450 |

*Primary Examiner*—William F. Pate, III
*Assistant Examiner*—Creighton Smith
*Attorney, Agent, or Firm*—Gifford, Groh, VanOphem, Sheridan, Sprinkle & Dolgorukov

[57] ABSTRACT

A frame for a waterbed having a standard thickness or height when inflated. The frame includes a stand positioned on the ground and a rectangular planar support member which is secured to the top of the stand so that the upper surface of the support member is substantially horizontal. A planar adapter having both a rectangular outer periphery and a rectangular inner periphery is secured to the top of the support member so that the outer periphery of the adapter is flush with the outer periphery of the support member. A sheet of insulation is contained within the inner periphery of the adapter and the thickness of the sheet is the same as the thickness or height of the adapter so that the top surface of the adapter and insulation sheet are on the same plane with each other. A standard rail assembly is secured to the top of the adapter so that the rail assembly protrudes upwardly from around the outer periphery of the adapter by an amount equal to the standard thickness of the waterbed balloon.

4 Claims, 3 Drawing Figures

WATERBED FRAME

BACKGROUND OF THE INVENTION

I. Field of the Invention

The present invention relates generally to bed frames and, more particularly, to a waterbed frame.

II. Description of the Prior Art

As shown in FIG. 3, most previously known waterbed frames are standard in construction and comprise a lower stand 100 which rests upon the ground support surface. A rectangular sheet of particle board 102 is placed or laid on the top of the stand so that the top of the particle board sheet is substantially horizontal. Furthermore, the particle board sheet is slightly greater in size than the standard size waterbed balloon 104.

A rail 106 is then secured along each side of the top of the particle board sheet 102 and the corners of the rails 106 are secured together thus forming a rectangular body designed to receive the waterbed balloon 104. The rails protrude upwardly from the particle board by an amount 108 equal to the height or thickness of a standard size waterbed balloon so that when the waterbed balloon is inflated to its proper amount, the top of the waterbed balloon 104 is approximately flush, i.e. on the same plane, with the top of the rails 106.

One disadvantage of waterbeds in general is that the waterbed is cold. For this reason, many waterbed users employ water heaters in order to heat the waterbed and thus render the waterbed more comfortable. Typically, a heating pad positioned in between the bottom of the waterbed balloon and the particle board support member forms the heater.

In order to minimize the heat loss from the waterbed balloon and thus minimize the energy cost for heating the waterbed balloon, many previously known waterbed balloon heaters utilize a thermal insulating blanket which extends around the sides and bottom of the waterbed balloon. The waterbed balloon heater is then positioned in between the thermal blanket and the bottom of the waterbed balloon, thus minimizing heat loss from the bottom and sides of the waterbed balloon.

A primary disadvantage of these previously known thermal blankets, however, is that the thermal blankets elevate the waterbed balloon upwardly from the particle board support member by an amount equal to the thickness of the thermal blanket. Since the waterbed balloon as well as the rails are manufactured in a standard size to fit each other, the thermal blanket thus elevates the waterbed balloon so that its top protrudes upwardly from the top of the rails. This, in turn, is disadvantageous for a number of different reasons.

One disadvantage of elevating the waterbed balloon so that it protrudes upwardly from the side rails is that the waterbed balloon overlaps the top of the rails somewhat so that the waterbed balloon can become pinched in between the side rails and an object on top of the waterbed balloon. This, in turn, can puncture the waterbed balloon and necessitate its repair or replacement.

A still further disadvantage of using a thermal blanket so that the waterbed balloon protrudes upwardly from the rails is that it is much easier for a person sleeping on the waterbed balloon to roll off from the top of it. This is particularly true with waterbeds as opposed to conventional beds since the top surface of the waterbed balloon naturally slopes downwardly from its center and towards its sides.

In order to overcome these problems when utilizing a thermal blanket, many waterbed users simply deflate the waterbed balloon until the top of the waterbed balloon is again flush with the top surface of the side rails. This solution, however, is not wholly satisfactory since, for proper use, the waterbed balloon must be inflated to a predetermined level. If the waterbed balloon is deflated below this level, the waterbed is less firm and will not provide the support originally intended for proper sleeping posture; intense back pain and spinal disorders may result.

SUMMARY OF THE PRESENT INVENTION

The present invention provides an adapter for a conventional waterbed balloon frame which overcomes all of the above mentioned disadvantages of the previously known devices.

In brief, the present invention comprises a stand which rests upon a ground support surface while a rectangular planar member, typically constructed of particle board, is positioned on top of the stand so that the upper surface of the support member is horizontal. The size of the support member, like the previously known waterbed balloon frames, is slightly greater than the size of a conventional waterbed balloon.

A planar adapter having a rectangular outer periphery and a rectangular inner periphery is then positioned on top of and around the edges of the support member. The adapter is dimensioned so that its outer periphery is substantially flush with the outer periphery of the support member. In addition, the distance between the inner and outer periphery of the adapter is only a few inches so that the inner periphery of the adapter is just slightly less than the size of the waterbed balloon.

A sheet of hard insulation is then positioned within the inner periphery of the adapter and on top of the support member. This sheet of insulation has a thickness or height equal to the thickness or height of the adapter so that the top surface of the adapter and the insulation sheet are on the same plane with each other.

A rail having a standard height equal to the height of the waterbed balloon is then secured to the top of and around each edge of the adapter. The rails thus form a rectangular box designed to receive the waterbed balloon and the corners of the rails are secured together in any conventional fashion.

A primary advantage of the present invention is that the adapter enables rails having a standard height to be used with the standard height waterbed balloon so that, with the waterbed balloon inflated to its normal amount, the top surface of the waterbed balloon is still flush with the top of the rails. Furthermore, the sheet of insulation under the bottom of the waterbed balloon effectively prevents heat loss from the bottom of the waterbed balloon.

BRIEF DESCRIPTION OF THE DRAWING

A better understanding of the present invention will be had upon reference to the following detailed description when read in conjunction with the accompanying drawing wherein like reference characters refer to like parts throughout the several views, and in which.

DETAILED DESCRIPTION OF A PREFERRED EMBODIMENT OF THE PRESENT INVENTION

Figure 1:
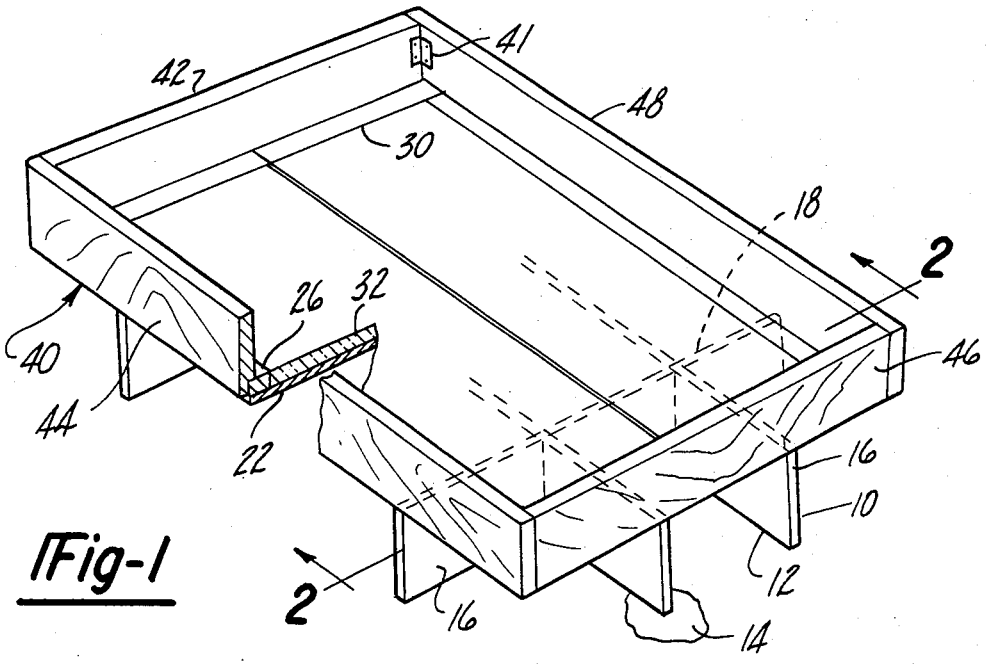
FIG. 1 is a perspective view illustrating a preferred embodiment of the present invention.

With reference first to FIG. 1, a preferred embodiment of the waterbed frame of the present invention is thereshown and comprises a stand 10 having a lower surface 12 adapted to rest upon a ground support surface 14. The stand 10 is conventional in construction and is constructed from criss-crossing members 16 which are connected to each other in any conventional fashion. A top surface 18 of the stand 10 is spaced apart from and parallel to its lower surface 12 and thus is horizontal.

Figure 2:
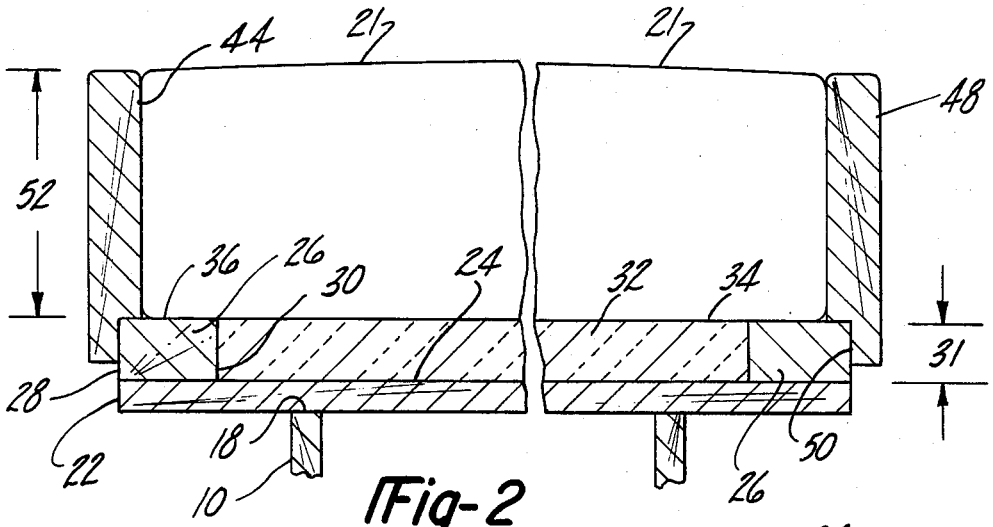
FIG. 2 is a cross sectional view taken substantially along FIG. 2—2 in FIG. 1.

Referring now to FIGS. 1 and 2, a generally planar and rectangular support member 22 is positioned on the top surface 18 of the stand 10 so that an upper surface 24 of the support member 22 lies in a horizontal plane. The support member 22, constructed from any conventional material, such as particle board, may be constructed from one or more pieces. In addition, the support member 22 is generally rectangular in shape having a size slightly greater in area than the size of the waterbed balloon 21.

An adapter 26 having a rectangular outer periphery 28 and a rectangular inner periphery 30 is positioned on the upper surface 24 of the support member 22 so that the outer periphery 28 of the adapter 26 is substantially flush with the outer periphery of the support member 22. The inner periphery 30 of the adapter 26 is spaced only a few inches from its outer periphery 28 so that the size of the rectangle formed by the inner periphery 30 of the adapter 26 is only slightly smaller than the size of the waterbed balloon 21.

The adapter 26 is constructed of any conventional material, such as wood, and can be constructed from one or more pieces. The adapter 26 is secured to the support member 22 in any conventional fashion such as by gluing, screws, or the like.

A sheet of hard insulation 32, which may be constructed from one or more pieces, is then positioned on the upper surface 24 of the support member 22 and within the inner periphery 30 of the adapted 26. Furthermore, as is best shown in FIG. 2, the thickness or height 31 of the insulation sheet 32 is substantially the same as the thickness or height of the adapter 26 so that a top surface 34 of the insulation sheet 32 is on a common plane with the top surface 36 of the adapter 26.

Figure 3:
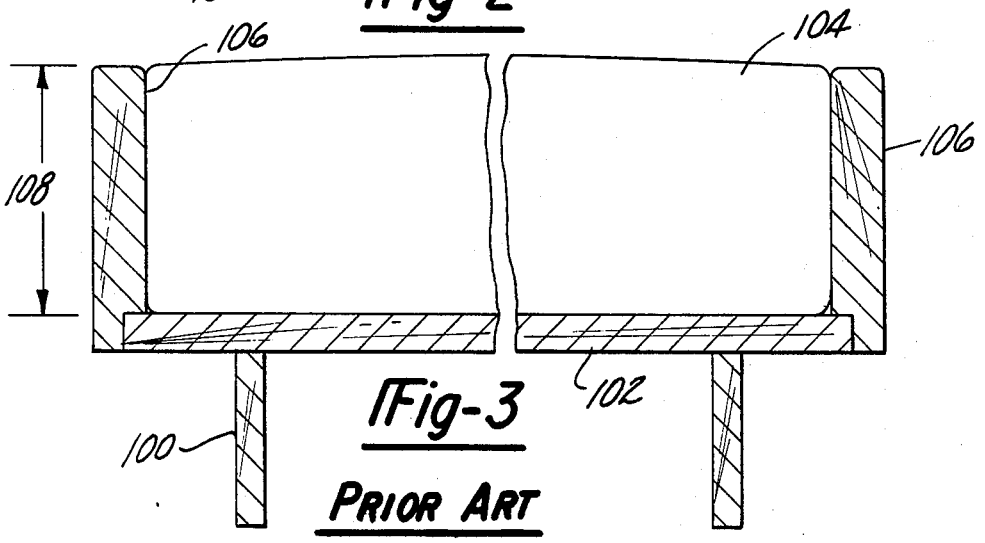
Fig-3 PRIOR ART
FIG. 3 is a prior art cross sectional view.

A rail assembly 40 comprising four separate rails 42, 44, 46 and 48 is then secured on the outer periphery 28 of the adapter 26 so that the rails 42–48 extend upwardly from the adapter 26 and form a box which receives the waterbed balloon 21. Each rail 42–48 has a rectangular notch 50 along its lower inner edge which is dimensioned to be positioned over the top surface 36 of the adapter 26. In addition, each rail 42–48 has a standard interior height 52 (reference character 108 in FIG. 3) which is equal to the height of the waterbed balloon 21. The rails at each corner of the rail 42–48 assembly 40 are attached together by any conventional means 41 (FIG. 1).

With the waterbed frame assembled as previously described, the waterbed balloon 21 is positioned within the interior or "box" of the rail assembly 40 and so that the bottom of the waterbed balloon 21 rests on the top surface 34 of the insulation sheet 32. The waterbed balloon 21 is then inflated to its normal amount so that the top of the waterbed balloon 21 is flush with the top of the rail assembly 40, thus completing the assembly of the waterbed.

A primary advantage of the present invention is that the adapter 26 spaces the rail assembly 40 upwardly from the support member 22 by a distance equal to the thickness of the insulation sheet 32. Consequently, with the waterbed balloon 21 inflated to its normal amount, the waterbed balloon 21 is flush with the top of the rail assembly 40 in the desired fashion. Furthermore, the present invention thermally insulates the waterbed from thermal loss through its bottom by providing the insulation sheet 32 and, simultaneously, allows the rails 42–48 to have a standard interior height 52 corresponding to the height of the waterbed balloon 21 to be used. Consequently, the adapter 26 allows a standard waterbed frame to be used while thermally insulating the bottom of the waterbed against thermal loss. A conventional heater (not shown) is usually sandwiched in between the insulation sheet 32 and the bottom of the waterbed balloon 21.

Having described my invention, however, many modifications thereto will become apparent to those skilled in the art to which it pertains without deviation from the spirit of the invention as defined by the scope of the appended claims.

I claim:

1. A frame for a waterbed balloon having a standard predetermined thickness when inflated, said frame comprising:

a stand having a lower surface adapted to rest on a ground support, a generally rectangular and planar support member positioned on top of said stand so that an upper surface of said support member is substantially horizontal, a substantially planar adapter positioned on and in abutment with said upper surface of said support member, said adapter having an outer periphery which is substantially rectangular and flush with an outer periphery of said support member, said adapter having a substantially rectangular inner periphery spaced inwardly from its outer periphery, and said adapter having a height of a predetermined amount, a sheet of insulation contained within and extending entirely across the inner periphery of said adapter, said sheet having a thickness equal to said predetermined amount so that an upper surface of said sheet is substantialy on a same plane with an upper surface of said adapter, and a rail assembly secured to said upper surface of said adapter and extending around the entire periphery of said adapter, said rail assembly extending upwardly from said adapter by a height substantially equal to said standard predetermined thickness and having a substantially rectangular inner periphery, wherein, with said waterbed balloon positioned in said frame, a bottom surface of said balloon is supported by said upper surface of said sheet and said upper surface of said adapter, and said surfaces of said balloon are in abutment with said inner periphery of said rail assembly so that said rail assembly surrounds and contains said waterbed balloon.

2. The invention as defined in claim 1 wherein said rail assembly comprises four elongated rails, one rail extending along each side of said adapter, and means for securing said rails together at their corners.

3. The invention as defined in claim 1 wherein said sheet of insulation comprises hard insulation.

4. The invention as defined in claim 1 wherein said stand comprises a plurality of criss-crossing slats.

* * * * *